US008504442B2

(12) United States Patent
Golden et al.

(10) Patent No.: US 8,504,442 B2
(45) Date of Patent: Aug. 6, 2013

(54) BIDDING ON A PLURALITY OF PRODUCTS OR SERVICES WITH CONTINGENCIES

(75) Inventors: Aaron B. Golden, San Francisco, CA (US); Michael J. Marston, Austin, TX (US)

(73) Assignee: Adbucket Com Inc, San Francisco, CA (US)

( * ) Notice: Subject to any disclaimer, the term of this patent is extended or adjusted under 35 U.S.C. 154(b) by 104 days.

(21) Appl. No.: 13/102,555

(22) Filed: May 6, 2011

(65) Prior Publication Data

US 2012/0284136 A1 Nov. 8, 2012

(51) Int. Cl.
*G06Q 30/00* (2012.01)

(52) U.S. Cl.
USPC ..... 705/26.8; 705/26.1; 705/26.41; 705/27.1

(58) Field of Classification Search
USPC ..... 705/26.1–27.2, 80
See application file for complete search history.

(56) References Cited

U.S. PATENT DOCUMENTS

| | | | | |
|---|---|---|---|---|
| 5,794,219 | A | 8/1998 | Brown | |
| 6,499,018 | B1 | 12/2002 | Alaia et al. | |
| 7,165,046 | B2 | 1/2007 | Ausubel | |
| 7,383,206 | B2 | 6/2008 | Rupp et al. | |
| 7,801,793 | B2 | 9/2010 | Wiesehuegel et al. | |
| 7,840,447 | B2 | 11/2010 | Kleinrock et al. | |
| 7,870,050 | B2 | 1/2011 | Ausubel | |
| 7,937,312 | B1 | 5/2011 | Woolston | |
| 7,962,402 | B2 | 6/2011 | Eydelman | |
| 2008/0021808 | A1* | 1/2008 | Edlund et al. | 705/37 |
| 2008/0040232 | A1* | 2/2008 | Perchthaler | 705/26 |
| 2008/0097864 | A1* | 4/2008 | Patel et al. | 705/26 |
| 2008/0097927 | A1* | 4/2008 | Renzi | 705/80 |
| 2011/0071935 | A1* | 3/2011 | Balabon | 705/37 |
| 2011/0078037 | A1* | 3/2011 | Erisman | 705/26.3 |
| 2011/0106646 | A1* | 5/2011 | Gordon | 705/26.3 |
| 2012/0047076 | A1* | 2/2012 | Burney | 705/80 |

OTHER PUBLICATIONS

Swapace Pty Ltd Files Patent Application for a Method and System for Allowing a User to Make a Plurality of Offers to a Plurality of Advertisers Indian Patents News [New Delhi] Feb. 8, 2011.*

* cited by examiner

*Primary Examiner* — William Allen
(74) *Attorney, Agent, or Firm* — Meyertons Hood Kivlin Kowert & Goetzel, P.C.; Jeffrey C. Hood; Joel L. Stevens

(57) ABSTRACT

Bidding on a plurality of items with contingencies. Input may be received from a buyer over a wide area network. The input may specify a plurality of offers for purchase of a respective plurality of items and the offers may be included in a collection of offers. One or more contingencies may be associated with the collection of offers, e.g., in response to user input. The one or more contingencies may specify cancellation of one or more of the plurality of offers within the collection of offers. Input may be received from a seller over the wide area network, specifying an acceptance of a first offer of the plurality of offers in the collection of offers. At least one of the plurality of offers within the collection of offers may be automatically canceled based on the one or more contingencies and possibly the acceptance of the first offer.

22 Claims, 6 Drawing Sheets

AdBucket Log In | Sign Up

Outdoor Advertising Simplified WHAT IS ADBUCKET? HOW IT WORKS LEARN ABOUT OUTDOOR ADVERTISING

AD: #L4RM38K8BL (Billboard – Bulletin)

Save This Ad to Favorites

Map

Actual Image(s)

Aspect Ratio

193' 720'

Information:

Location: Loc #4264, San Francisco, CA 92222
Lat 37.75xLong-122.42

List Price: $1,200.00 / 4 weeks

Print Estimate: $100.00

Size: 720x193

Read: Right Side

Facing: SE

Lighted: No

EOI: 8,500

Description:

This unit is located on I-55, along one of the faster growing corridors within the Chicago Metro area. Target areas include Naperville, Plainfield, Bolingbrook, Romeoville and Joliet, IL. Many of these communities were listed among the fastest growing cities in the United States, with populations in excess of 100,000. This location is between Exit 263 – Weber rd and Exit 257 – US Hwy 30, targeting northbound traffic Restictions:

No pornography, No sexually explicity, material, No Tobacco or Alcohol, No gambling, No violence. It is the buyer's responsibility to make sure your advertising content abides by all local, state, and federal laws.

Make an Offer:

The dates I want my ad to be live are 05/03/2011 to 07/30/2011

The amount I'd like to offer is 8000 total time duration add flight

- Creative change allowance(s) for this time period: 1

Link this offer to other offers? NO What's This?

Important information about your offer:

- Estimated printing/production cost not included
- Offer price includes installation and taxes
- Seller is responsible for the accuracy of all data displayed in each profile
- If the seller accepts your offer, the transaction is binding
- If the seller does not agree to your price, seller may recommend another offer
- You will not be allowed to change the creative more than once per X
- You will have a chance to review prior to submission Make Offer

FIG. 4

BIDDING ON A PLURALITY OF PRODUCTS OR SERVICES WITH CONTINGENCIES

FIELD OF THE INVENTION

The present invention generally relates to e-commerce, and more specifically to systems and methods for bidding on a plurality of products or services with contingencies.

DESCRIPTION OF THE RELATED ART

Historically, users have been able to perform online purchasing of products or services. For example, some online sites allow buyers to present offers (e.g., bids, such as during an auction) online between a buyer and a seller and are widely adopted by many industries. In the past, online purchasing relationships have been enabled in a variety of ways, including the idea of making offers on a particular product directly to a seller and grouping products in order to get bulk pricing discounts. Group buying has also been used to drive down the price of a unit by allowing a group to purchase a single unit. This collective purchasing model has enabled products and services to be sold at a discount based on the total number of units sold, driving increased sales. Online purchasing is different than the offline group buying in the past where a consumer had to visit the seller's pre-selected and pre-priced collection of products in order to make a purchase. Online group buying has also grouped consumers as a way of collectively purchasing one or many products to drive down the price.

However, in typical purchasing systems, such as bidding systems, buyers are essentially forced to make offers on items only one at a time. For example, a buyer may wish to buy an item that is auctioned by a several different sellers. In a first case, the buyer may provide an offer for the item for several different sellers; however, this behavior may ultimately require the buyer to purchase more than one of the items and/or exceed the maximum investment a buyer wants to make. Alternatively, the buyer may simply make a single offer for the item for one of the sellers; however, the buyer may not receive the most desirable price available (e.g., than would be possible when making the offer to multiple sellers) and/or may not be able to purchase the item (e.g., if the seller denies the offer or accepts the offer of a different buyer). Accordingly, improvements in online purchasing are desired.

SUMMARY OF THE INVENTION

Various embodiments are described of a system and method for bidding on a plurality of products or services with contingencies.

Embodiments described herein allow buyers the ability to globally locate products or services through an electronic commerce system, and enable all buyers wishing to purchase a particular product or service within a given time frame the ability to manually or automatically group one or more offers on a variety of products or services into a collection of offers (also referred to as a "bucket", "offer bucket", or "bucket of offers"). Offers may be submitted either individually, as the buyer chooses, or collectively when a "bucket" is published (e.g., predetermined by an seller or other entity). In some embodiments, the buyer's ability to pay for items (e.g., via bank account, credit card, etc.) may be validated prior to an offer being submitted. Thus, a buyer may initially make a plurality of offers and the offers may be grouped together into a collection of offers.

The buyer may be able to place conditions (also referred to as "contingencies") on the offers in the bucket; however, in alternate embodiments, the contingencies may be automatically determined (e.g., there may be a default condition or other rules for automatically determining the conditions). Accordingly, upon the contingencies being met for the bucket of offers (or individual ones within the bucket), such as one of the offers being accepted by a seller, some or all of the unaccepted offers within the bucket may be automatically withdrawn and no longer capable of being accepted by sellers.

As an example, a buyer may place a plurality of offers in a bucket, e.g., for a similar item. Accordingly, the first seller or sellers to accept an offer in the bucket may enter a binding contract with the buyer. Where the contingency of the bucket is a single acceptance, all remaining open offers in the bucket may be terminated. However, other contingencies are envisioned as well, such as a price limit (e.g., where accepted offers are not allowed to exceed a certain payment amount), a higher number of accepted offers (e.g., 2, 3, 4, 5, 10, etc.), time limit (e.g., specifying an expiration time of the bucket), etc. Any possible contingency is envisioned.

In further embodiments, the offers and/or contingencies may specified as rules. For example, a buyer may specify that the offering price of one or more of the offers are to increase or decrease at a certain rate, e.g., up (or down) to a threshold amount. Similarly, the price limit on the bucket may change over time, according to rules specified by the buyer. Thus, the bucket of offers may have any type of contingency placed on it. This superior purchasing model will often result in a lower priced product or service with less risk to the buyer and more opportunity for a seller.

All buyer proposed offers at the buyer's proposed price may remain legally and financially binding offers until the offer is withdrawn (e.g., based on a contingency), accepted by a seller, or rejected by a seller. In one embodiment, when an offer is accepted by a seller, both the buyer and seller enter a legally and financially binding contract. Additional offers may be added to a bucket at any time and can run concurrently, but it is not a requirement.

Additionally, the method may allow gather market and pricing information, e.g., based on buyer and seller offer and sale history. For example, as indicated above, buyers making offers on products or services may submit a binding offer guaranteeing their willingness to purchase a set of items (e.g., a predetermined selection of featured item(s)) at or below the maximum price determined at the time the offer was made. This bucket of offers provides valuable quantitative data regarding price sensitivity for any given item within its perspective market as well as seller tolerance to accept offers on featured items. In addition, it permits real time yield management through pre-determined conditions applied to products and services at the time an offer is made. If a seller has pre-determined characteristics established for a particular product or service that denotes an auto accept price, then both buyer and seller may be instantly notified of a successful transaction upon seller acceptance.

BRIEF DESCRIPTION OF THE DRAWINGS

A better understanding of the present invention may be obtained when the following detailed description is considered in conjunction with the following drawings, in which:

FIG. 4 depicts a user placing an offer, according to one embodiment;

Figure 1:
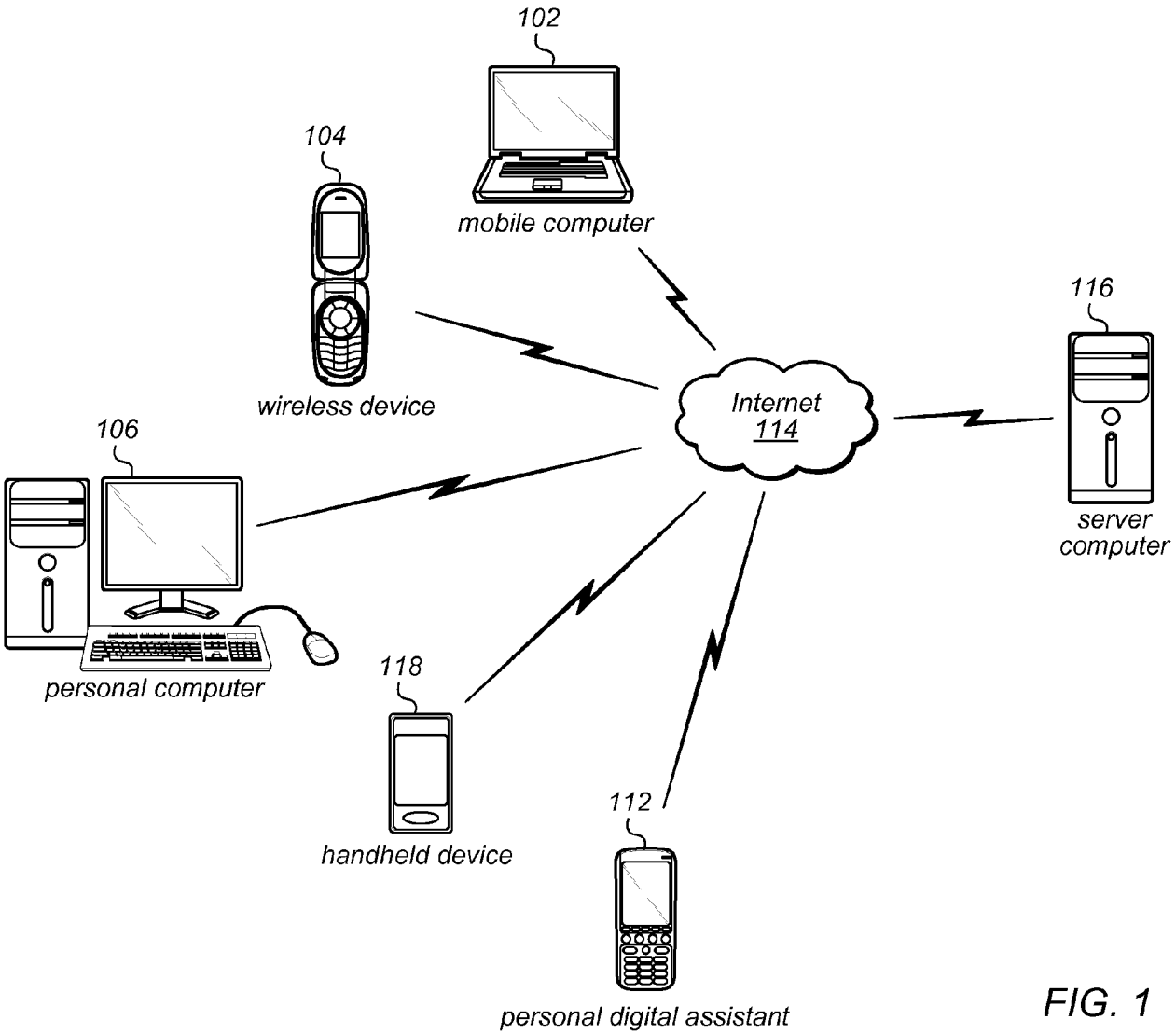
FIG. 1 is a system diagram for implementing embodiment described herein, according to one embodiment.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE EMBODIMENTS

Terms

The following is a glossary of terms used in the present application:

Memory Medium—Any of various types of memory devices or storage devices. The term "memory medium" is intended to include an installation medium, e.g., a CD-ROM, floppy disks, or tape device; a computer system memory or random access memory such as DRAM, DDR RAM, SRAM, EDO RAM, Rambus RAM, etc.; or a non-volatile memory such as a magnetic media, e.g., a hard drive, or optical storage. The memory medium may comprise other types of memory as well, or combinations thereof. In addition, the memory medium may be located in a first computer in which the programs are executed, or may be located in a second different computer which connects to the first computer over a network, such as the Internet. In the latter instance, the second computer may provide program instructions to the first computer for execution. The term "memory medium" may include two or more memory mediums which may reside in different locations, e.g., in different computers that are connected over a network.

Carrier Medium—a memory medium as described above, as well as a physical transmission medium, such as a bus, network, and/or other physical transmission medium that conveys signals such as electrical, electromagnetic, or digital signals.

Computer System—any of various types of computing or processing systems, including a personal computer system (PC), mainframe computer system, workstation, network appliance, Internet appliance, personal digital assistant (PDA), smart phone, television system, grid computing system, or other device or combinations of devices. In general, the term "computer system" can be broadly defined to encompass any device (or combination of devices) having at least one processor that executes instructions from a memory medium.

Automatically—refers to an action or operation performed by a computer system (e.g., software executed by the computer system) or device (e.g., circuitry, programmable hardware elements, ASICs, etc.), without user input directly specifying or performing the action or operation. Thus the term "automatically" is in contrast to an operation being manually performed or specified by the user, where the user provides input to directly perform the operation. An automatic procedure may be initiated by input provided by the user, but the subsequent actions that are performed "automatically" are not specified by the user, i.e., are not performed "manually", where the user specifies each action to perform. For example, a user filling out an electronic form by selecting each field and providing input specifying information (e.g., by typing information, selecting check boxes, radio selections, etc.) is filling out the form manually, even though the computer system must update the form in response to the user actions. The form may be automatically filled out by the computer system where the computer system (e.g., software executing on the computer system) analyzes the fields of the form and fills in the form without any user input specifying the answers to the fields. As indicated above, the user may invoke the automatic filling of the form, but is not involved in the actual filling of the form (e.g., the user is not manually specifying answers to fields but rather they are being automatically completed). The present specification provides various examples of operations being automatically performed in response to actions the user has taken.

Offer or Purchase Offer—an agreement to purchase a featured product or service, e.g., by a buyer. The offer may be a binding offer which may be guaranteed by the buyer, e.g., using a payment method specified at the time and offer is made. An offer, depending on the commerce system, may or may not be cancellable or non-cancellable as long a certain conditions are met.

Group or Bucket—as used herein, "bucket or group" are interchangeable and intended to refer to any number of items (units) greater than one, clustered together to form one collection. A group or bucket will consist of at least one offer, although some references to a bucket may indicate a bucket or group of only one offer. Contingencies on buckets may not go into effect until more than one item is in a bucket.

Product or service—a product or service is an item for sale by a seller, which have defining characteristics. For example a product may be an object having a specific size, color, shape, texture, availability, attributes (such as "mechanized"), dimensions, location, price, etc. Similarly, a service may be any activity or deliverable that is provided by a third party, e.g., in response to payment. A product or services will have unique characteristics and may vary depending on the product or service category and type.

Item—a product or service or a collection of products and services. An item can be a tangible or intangible object or service.

Browser—A specific type of client system or client application used to communicate with the commerce server, such as an HTTP browser, enabling the reception and display of various forms of information (e.g., within a webpage) and sending of information, such as a request of the end user. Note that a browser is not the only possible or intended client system.

FIG. 1—Exemplary System

FIG. 1 illustrates one embodiment of a system that may implement embodiments described herein. However, these systems are exemplary only and other systems and configurations are envisioned.

As shown in FIG. 1, a plurality of buyers and sellers may be coupled to a server of an ecommerce system over the Internet. As used herein, a "buyer" is defined by a customer or potential customer who is placing offers on or on behalf of an interested party. As user herein, a "seller" is defined by an entity, such as a person or company, that provides items for purchase by buyers. The buyers and sellers may interact with each other and/or the server 116 via any of various types of devices, such as those shown in FIG. 1. For example, buyers and sellers may use any one or more of mobile computer 102 (such as a netbook, tablet computer, etc.), wireless device 104 (such as a cell phone or smart phone), personal computer 106, laptop computer 108, handheld device 110, and personal digital assistant 112.

In one embodiment, the buyer or seller may access the server 116 (which may actually include a plurality of servers, such as a server farm) by inputting the commerce system identifier (e.g., a URL) into a client program (such as a browser) executing on the client device. Accordingly, the server 116 may provide information to the client device over the Internet 114 for display, such as webpage information. The server 116 may include one or more memory mediums storing program instructions that are executable by processor(s) of the server 116 to allow buyers to purchase items from the sellers according to the methods described herein. For example, the server 116 may provide or host a website that allows the buyers and sellers to interact in the manner described below.

Figure 2:
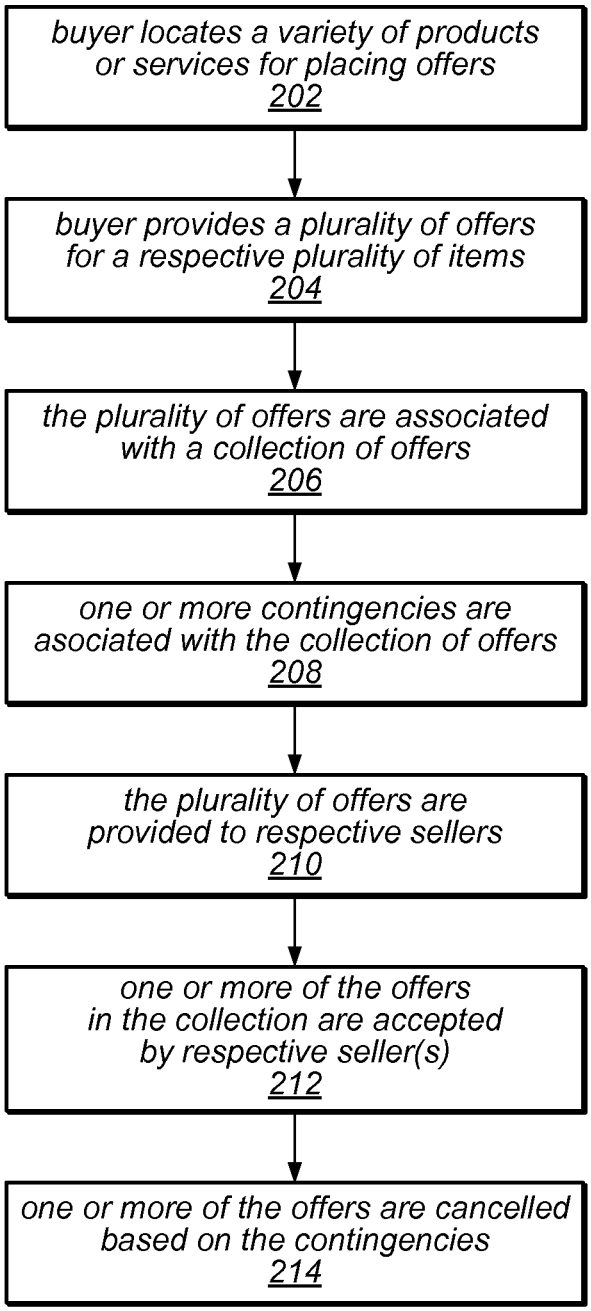
FIG. 2 is a flow chart diagram for making a plurality of offers with contingencies, according to one embodiment.

FIG. 2—Canceling Offers in a Collection of Offers Based on Contingencies

FIG. 2 is a flowchart diagram illustrating one embodiment of a method for canceling offers in a collection of offers based on contingencies. The method shown in FIG. 2 may be used in conjunction with any of the computer systems or devices shown in the above Figures, among other devices. In various embodiments, some of the method elements shown may be performed concurrently, performed in a different order than shown, or omitted. Additional method elements may also be performed as desired. As shown, this method may operate as follows.

In 202, the buyer may locate a variety of products or services, and in 204, the buyer may to place offers on a plurality of items. The buyer may locate and place the offers through an ecommerce system, such as one hosted by the server 116. For example, the ecommerce system may provide an interface (e.g., in a website, although the interface may be part of an application executing on a client device of the user) for locating and purchasing items provided by sellers. However, note that, in one embodiment, the items buyers place offers on may be provided by sellers through the commerce system, not by the company running the ecommerce system.

The interface may include a listing of available categories of items. For example, the ecommerce system may receive a listing request from a buyer and a listing server may generate a list of available categories of items stored and itemized in a table for the buyer's selection. The ecommerce system may transmit the category list for display on an interface of a buyer's client, such as those shown in FIG. 1.

Additionally, or alternatively, the interface generated by the ecommerce server may allow the buyer to enter search or navigation criteria. The search or navigation criteria may be selectable from the category list discussed above. In one embodiment, the user may use a map with geo-location of products or services for specifying criteria of desired items. In further embodiments, the buyer may use a text search feature provided in the interface for searching for desired items.

In one specific example, the buyer may select a category preference from the category list or generates search criteria. The buyer may then transmit the category preference and/or search criteria, again, via the Internet. Upon receipt of the category preference and/or search criteria, the ecommerce system may use a search server to generate an item index page of relevant offerings including visual indicators displayed in respect to items in which the seller is allowing a buyer to make an offer on to purchase. Utilizing the offer price process, buyers are given the option to place offers for listed items. The offer price may be within or a price range of acceptability set by the seller, or potentially, the price range may not be provided to the buyer and the buyer may simply make offers at prices that are acceptable to the buyer. Once an offer is made, the item is transmitted to the seller via the Internet 204 through a server where the information is stored 206.

Each offer may have unique characteristics that may or may not have similarities. For example, a first offer may be for a car and the another offer may be for a billboard ad. The characteristics of the buyer proposed offer may be specific to the type of product or service they are making an offer on. Offers may be placed at the same time or over different times if the buyer chooses. For example, the buyer may choose to publish all buyer proposed offers (e.g., within a same bucket) at the same time, thus notifying the sellers at the same time. This behavior may provide an equal opportunity from a time perspective for sellers to respond to the offers. Alternatively, the buyer may also elect to publish each offer as the offers are made. In contrast to the above, this behavior may limit a seller's ability to have an equal opportunity from a time perspective to respond to the offer. The behavior of each offer may be determined by a combination of pre-determined variables set up by a seller for the buyer to make offers on. All pre-determined variables are not necessarily provided to a buyer thought the commerce system. More specifically, a buyer may submit an offer without full disclosure on all variables established by the seller on a particular product or service.

In 206, the plurality of offers may be associated or bundled with a collection of offers. For example, the buyer may provide an offer for a first item following the descriptions above and then provide an offer for a second item. The buyer may choose to associate the two offers in a collection (or "bucket") of offers. Alternatively, rather than assembling the collection of offers one offer at a time, a buyer may be able to select a plurality of items and generate a collection of offers for the plurality of items at the same time. In further embodiments, the buyer may be able to select a pre-determined collection (e.g., with or without offers already made). Thus, the collection of offers may be generated in a piecemeal fashion or all at once, as desired.

In 208, the buyer may be able to place one or more contingencies on the offers in the collection; however, in alternate embodiments, the contingencies may be automatically determined (e.g., there may be a default contingency or other rules for automatically determining the contingency). For example, each collection of offers may have a default contingency for acceptance of only a single offer. Accordingly, upon the contingencies being met for the bucket of offers (or individual ones within the bucket), such as one of the offers being accepted by a seller, some or all of the unaccepted offers within the bucket may be automatically withdrawn and no longer capable of being accepted by sellers.

As an example, a buyer may place a plurality of offers in a bucket, e.g., for a similar item. Accordingly, the first seller or sellers to accept an offer in the bucket may enter a binding contract with the buyer. Where the contingency of the bucket is a single acceptance, all remaining open offers in the bucket may be terminated. However, other contingencies are envisioned as well, such as a price limit (e.g., where accepted offers are not allowed to exceed a certain payment amount), a higher number of accepted offers (e.g., 2, 3, 4, 5, 10, etc.), time limit (e.g., specifying an expiration time of the bucket), etc. Any possible contingency is envisioned. Other examples included direct contingencies placed on one or multiple offers in a bucket. In one specific example, A,B,C and D offers are made. The contingencies on the offers may include: If offer A is accepted, then offer C will auto cancel or if offer D is accepted, then offer B and C are auto canceled. Any number of variables could be established within a bucket or between buckets. Contingencies could also include additional financial or non-financial consideration by a seller. If a price contingency is set up perhaps a seller could decrease the buyer proposed offer to increase the probability of acceptance.

In further embodiments, the offers and/or contingencies may specified as rules. For example, a buyer may specify that the offering price of one or more of the offers are to increase or decrease at a certain rate, e.g., up (or down) to a threshold amount. Similarly, the price limit on the bucket may change over time, according to rules specified by the buyer. Thus, the bucket of offers may have any type of contingency placed on it.

In 210, the commerce system receives the buyer-proposed offers and notifies the seller of the buyer-proposed offer price (e.g., via email, instant messaging, automated phone notification system, and update of listing, among other well known mechanisms). For example, the offers may be provided to the seller in an interface provided by the ecommerce system (e.g., within a website hosted by the ecommerce system). Accordingly, the sellers associated with each item of each offer may receive a notification of the corresponding buyer-proposed offer price. In response, the seller may decline or accept (or ignore) the buyer-proposed offer price as an agreed-upon price of the item. In some embodiments, the seller's acceptance or declination may be performed in response to user input accepting or declining the offer from the buyer. Alternatively, the offer may be accepted or denied based on a set of rules, e.g., set by the seller. For example, the seller may have a rule with a threshold price for any incoming offer for a given item. Thus, the offer may be accepted or declined in a manual or automatic fashion, as desired.

In 212, one or more of the offers may be cancelled or withdrawn based on the contingencies of 208. For example, if a contingency on a bucket was that the total liability for the group was only on one of many offers made, then upon acceptance of that one offer, all other buyer-proposed offers may be automatically terminated in the network-based commerce system 212. As indicated above, numerous other contingencies are envisioned.

Figure 3:
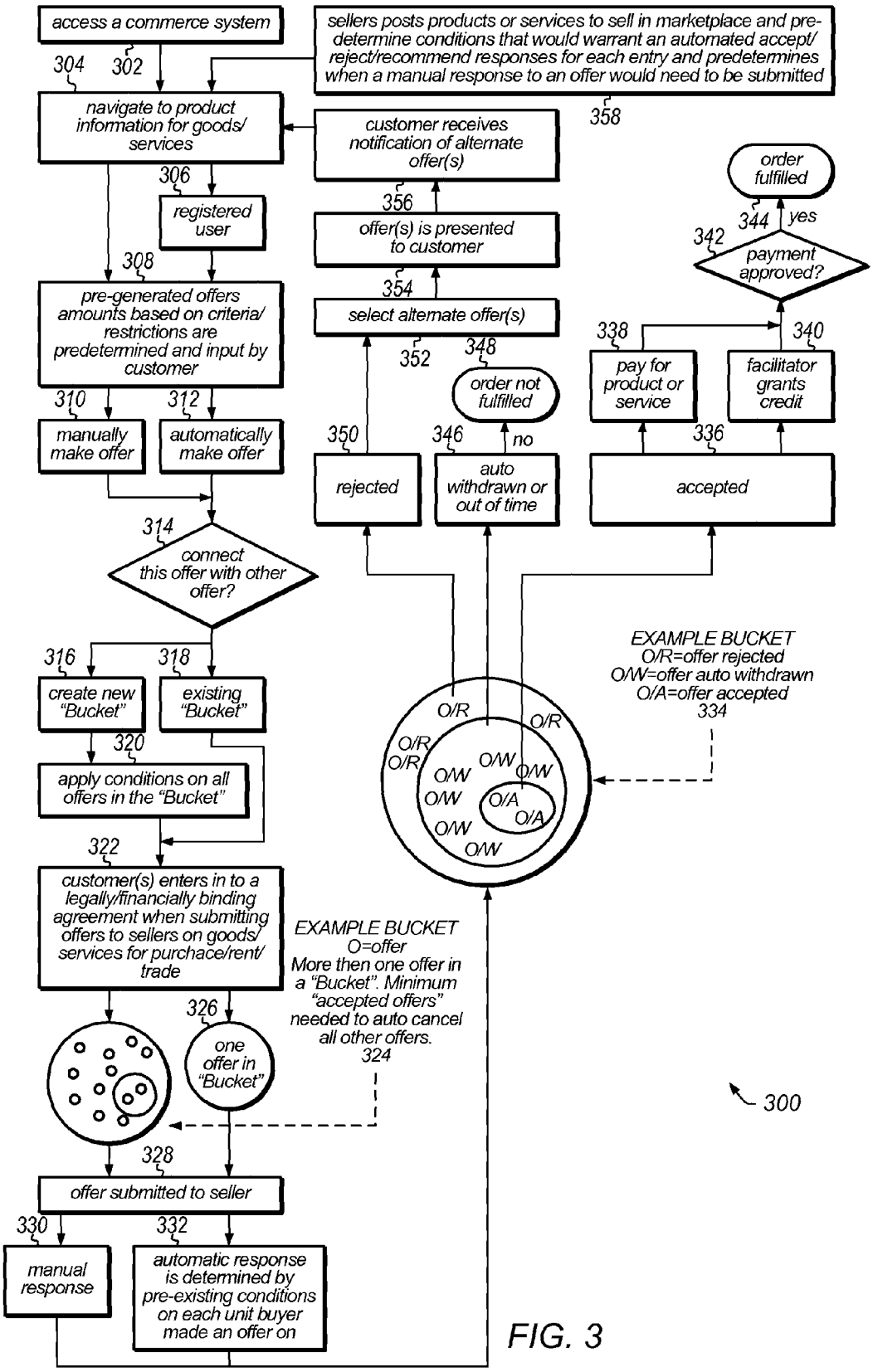
FIG. 3 is a detailed block diagram illustrating the necessary operations preformed to make offers, add offers to a group, and perform purchases, according to one embodiment.

FIG. 3—Detailed Offering Process with Contingencies

FIG. 3 is a flowchart diagram illustrating a more detailed embodiment of operations performed to place offers, add offers to a group, auto-withdraw offers in a group, and perform purchases. Note that while the embodiment of FIG. 3 provides numerous details for performing embodiments described herein, they are exemplary only and other variations are envisioned. The method shown in FIG. 3 may be used in conjunction with any of the computer systems or devices shown in the above Figures, among other devices. In various embodiments, some of the method elements shown may be performed concurrently, performed in a different order than shown, or omitted. Additional method elements may also be performed as desired. As shown, this method may operate as follows.

When a user comes to the website they have the option of identifying themselves as a buyer "client" or a seller. The users start by accessing a website 302 provided by the ecommerce system, which can be accessed through a variety of devices such as those shown in FIG. 1. The commerce system may provide a graphic representation to the user, communicating the products and services that a buyer is able to make offers on. More specifically, in one embodiment, a buyer is able to navigate the commerce system, which may display a listing of seller prepared offerings, goods and/or services. Thus, a buyer is able to navigate to product information for purchasing items in 304. It is assumed that the buyer has previously established an Internet connection, has access to the ecommerce system and may or may not be using Internet browser software to establish the connection.

In order for a buyer to make offers on products and or services, sellers may first successfully upload one or more listings to the seller database 358. Each listing may be given a unique identification number with one or more associated item identifiers and ideally, additional information about the item and the seller. Additional information about the item may include a textual description, a list of features or any other information that serves to describe the item and differentiate it from other comparable items with similar characteristics. This information could also include a suggested offer price, retail price, seller company name, email address, phone number, address, and payment preference. A unique seller database is made and updated as sellers publish items to the commerce system. Incorrect information will not enable a seller to take full advantage of system features. For example, without proper contact information a buyer may not be able to have questions answered about published items in the commerce system. Losing the ability to communicate questions directly to the seller e.g., (via commerce system email) limits buyer-seller interaction.

A successful upload of one or more products or services to sell in the marketplace may enable the seller to pre-determine conditions that would warrant an automated accept/reject/recommend response for each item and when a manual response to an offer would need to be submitted. The method to acquire listing information from a seller may vary depending on the needs of the commerce system owner and the seller.

One example of a condition that should be understood is that a reserve price may be set on an item. By setting a reserve price, a buyer can conditionally be automatically notified if the reserve price was not met. An example of a conditional notification would come in to effect if the seller does not want a notification of rejection published to a buyer. A reserve price may be broken out into several categories, offers that are automatically rejected, offers that are likely to be rejected but are still acceptable to submit, and offers that meet the reserve price but are still well below other offers for the same product or services. The reserve price can be increased for any offer that has yet to be made. In one embodiment, the reserve price for a listing may initially be set before or during current searches for the item but not after an offer has been submitted to the server. Sellers may not be able to artificially inflate the reserve price past the point of the product listing or higher than is appropriate for the product or service in a given market. This may keep a seller from submitting inflated item prices and then setting a reserve rate at the standard price goods and services are sold at.

A seller's willingness to publish a reserve price listing on an item that is otherwise hidden from the buyers on the ecommerce system protects the seller from receiving offers that are considered outliers and fall outside what the seller deems as acceptable offers. This is an important concept to note and understand given that buyers can be both in competition with other buyers and in competition with the reserve price.

The ecommerce system's maximum number of sellers may only be limited by the universe's potential to supply qualified sellers. In one embodiment, comparison shopping may be fundamental to the value of the commerce system. For example, the more options a buyer has to compare, the greater opportunity the buyer has to make offers on multiple products or services.

The process that a seller is instructed to go through in the ecommerce system may include the review and revision of listings of items in order to make suggestions to how the listing may be improved to increase the likelihood of offer acceptance—resulting in sale. For example, the commerce system may review the submitted listing by automatically checking the input fields and identifying those fields that lack completeness (e.g. photo on a listing, the amount of text description, location, size, color, type, etc.), or a lower price by analyzing local market competition for similar products or services.

The buyer may have limited access to all aspects of the commerce system until access is granted to the buyer after the buyer identifies unique characteristics in the commerce system. This is generally referred to as "log in", performed in 306. In one embodiment, "logging in" is not possible until the buyer completes a registration process. To enter into the buyer registration process, the buyer needs to establish a new account and fill out any necessary forms requesting information about the buyer issued by the commerce system. Requested information could include billing and shipping addresses, first and last name, payment information (such as credit card information), search preferences, demographic information, etc. Prior to either submissions it is important to point out that the process may require that the buyer submits a purchase offer coupled with a guaranteed payment (e.g., a credit card account number) to an electronic intermediary or established line of credit with governing body accepting payment.

At this point, the buyer may or may not be "logged in" to the commerce system. Products and/or services may be identified through a buyer interface where seller products and or services are displayed. A search for products or services could require information from the commerce server or directly from a seller server if product availability is updated in real time. The buyer may sort or filter returned initial posted items by size, price, distance, location, facing, lit, seller name, manufacture name, model number, daily estimated circulation, cost per thousand, item number, rating, user rating, color, shape, restrictions etc., by clicking on the appropriate filter buttons. While the above list may be particularly useful for billboards or advertising, other types of filters may be used for other products or services (e.g., such as consumer goods). In another embodiment, if a buyer is "logged in" the posted items by sellers could be automatically sorted or filtered and displayed based on pre-established criteria set by the buyer in 308. Examples could include pre-populating filtering criteria such as size, location, product category etc., along with page and layout preferences or displaying items. Buyers may select to automatically (312) or manually (310) make offers to sellers, as desired.

By manually making offers 310 a buyer may generate a buyer proposed offer price for an offered item listed on the commerce system. The buyer proposed offer price may be the price the seller is asking but will more likely be the price the buyer is willing to pay for the listed item (e.g., which may be below the asking price).

The ecommerce system may automatically make recommendations 312 to buyers on products that fit pre-established criteria in a user's profile. An example of this is if a buyer identifies criteria that indicates he will only pay a percentage "30%" of the seller suggested price on category type "billboards" on subset "bulletin billboards" that reach a minimum number of daily estimated circulation (DEC's) of amount "500,000" or more and are located in city "San Francisco". The ecommerce system identifies the criteria and provides items that match the requested criteria.

A buyer making an offer on an item with a buyer-generated price is binding. Prior to submitting the offer to the seller, the buyer is given the option to connect the offer to other offers 314 thus adding a contingency on all grouped offers in that particular bucket. A submitted offer that is placed into a bucket or group is still legally and financially binding. The difference is that the offered item acceptance is now contingent on the actions of any and all sellers who have products and or services that a buyer has made offers on in the same bucket.

The buyer may elect to a) create a new bucket in 316 or b) add the offer to an existing bucket in 318.

The election to create a new bucket may require no action on the part of a buyer. In one embodiment, the buyer may submit the offer or add more than one offer to the bucket. Contingencies may only be applicable when there is more than one offer in a bucket. Additionally, some contingencies (e.g., default contingencies) may be automatically added. In these circumstances the buyer may want to add or alter the contingencies on the bucket prior to adding a second item. Contingencies can be added and altered until the bucket has closed (e.g., when the bucket of offers is submitted).

By connecting the offer with another offer or offers in 320, the buyer may be requesting a contingency on the offer. A contingency may limit the buyer's total exposure in the marketplace, thus limiting financial risk and liability. Placing a contingency on buckets also provides the buyer and seller with unique advantages. For example, a grouped offer is seen by the commerce system as a micro-seller marketplace where sellers are provided offers on their products and services. Some sellers may receive multiple offers on each listed item a buyer can make an offer on.

When a bucket is created, a buyer enters into a process by which parameters (such as contingencies) are set for all offers in the bucket. The contingencies for each bucket may vary but apply to all offers in the bucket as a bucket or group is seen A buyer agrees to enter into a legally and financially binding agreement when submitting offers to seller on goods and services for purchase, rent or trade in 322. Upon an offer being accepted by a seller the agreement may then become a mutual legally and financially binding contract. When a buyer selects a buyer opt-in indication to opt in to a binding agreement with a seller, the offer price may then be fixed and the offer price may no longer be adjustable by the buyer at or below the submitted offer amount. Past this point, in one embodiment, if a buyer wants to submit an offer below the amount, the current offer would need to be terminated and a new offer would need to be submitted. When a buyer places an offer (or a bid) on an item, the buyer may be provided an offer confirmation page to make the offer binding. In one embodiment, if the buyer does nothing, the offer is not submitted. If the buyer chooses to agree and place an offer, the buyer may then be bound to a maximum offer price set by the buyer. In one embodiment, this is of course only after the buyer chooses to submit the offer to the seller 332 without attaching the offer to other offers, thus making it a bucket of one 324. Alternatively, the buyer may choose to submit the offer to the seller but first attaching the offer to another offer thus putting the offer in a bucket in 324.

Adding an offer to other offers, thus creating a group or "bucket", limits the total financial risk to the buyer by only holding the buyer accountable for purchase of items based on the contingencies set for the bucket. For example, if a bucket has 12 offers in the group and the contingencies (e.g., pre-established contingencies) dictate that the group will be terminated and the bucket will be closed when two offers in the bucket are accepted, then the buyer is only responsible to complete transaction on the two selected. As a more specific example, if each buyer submitted offer was $100 dollars each, then the total bucket of offers would equal $1,200.00 and because the contingency is that only two need can be accepted to close the group, the buyer only has $200.00 dollars of exposure.

It is important to note that buckets are not fixed and offers in buckets can move around from bucket to bucket, e.g., in response to user input. This ability may enable a buyer to evaluate each opportunity in each bucket and determine the overall potential of an offer's acceptance over others that may be withdrawn or rejected. For example, if a buyer believes that an offer in one bucket has a high likelihood to be accepted, but not as high as other offers in the group (thus making it an offer that has a lower likelihood of being accepted) then the buyer may want to move the offer to a group that will give it a better chance to be accepted among the group of offers in the bucket. The buyer's offer or offers may be communicated to a plurality of specific sellers.

When a buyer generates a buyer-proposed price for an item listed on the ecommerce system, in 328, the ecommerce system notifies the seller (e.g., via email, instant messaging, and update of listing, among other well known mechanisms) of the item if it meets the reserve price and if it is known to be available at the time the request is made. Depending on the rules established by the seller on posted items, the seller may be given the option to accept or reject the offer manually in 330 or the offer may be automatically accepted or rejected in 332. A manual response may require the seller to transmit the indication of acceptance or rejection of the buyer-proposed offer price to the network-based commerce system.

334 depicts an exemplary graphic representation of a bucket. Buckets may have three major components that can result from seller-initiated actions. After a seller has been notified of a buyer submitted offer, the seller has many choices on how to respond or not respond. The seller may choose to do nothing and not respond to the buyer's offer at all. This may likely result in an auto-withdrawn offer in 346 either because other offers in the group are accepted, or because the bucket will simply close due to the limited amount of time the bucket was pre-selected to stay open for (e.g., as specified in a contingency of the bucket).

In the event that the buyer proposed offer price is not accepted (and thus rejected) manually through the network-based commerce system, the seller may be presented with the opportunity to alter the buyer proposed offer in a variety of ways and the offer group or bucket may remain open, unless the offer is absent of a group or bucket and is independent of all other offers. Thus, the seller can reject the offer completely or partially in 350 which will give the seller an opportunity to recommend a new offer or counteroffer depending on the availability of the inventory and commerce system. The seller can also accept the offer in 336 which may bind the buyer and seller in a legally financially contract.

In the example bucket 334, four offers were rejected and six offers were automatically withdrawn because a response was not provided prior to the acceptance of the required two offers necessary to close the bucket, thus auto-withdrawing the remaining outstanding non-responsive seller's offers.

Upon the acceptance of a buyer-proposed offer price, either automatic or manual capturing funds prior to final notification of acceptance to the buyer may need to take place. For example, after a buyer's proposed offer is accepted by the seller, the ecommerce financial accounting system may debit the appropriate payment for the product or service sold in 338. Buyer oriented initiatives such as open profiling standards (OPS and E-Commerce Markup Language ECML) are attempts to create an electric wallet so that the buyer does not have to repeat the process of re-entering name, address and associated credit card information each time an offer is accepted.

In various embodiments, an alternative form of payment is a non-monetary payment. In embodiments the non-monetary payment includes trade or barter or transaction credits associated with the buyer account; this could also include virtual currency. This of course assumes that the seller has previously agreed to accept such forms of payment by the buyer. Financial terms may differ depending on the payment method selected.

Credit terms may also be used as a way to confirm intentions of payment. A facilitator such as a crediting agency 340 may be implemented to mitigate the need for up-front financial payment.

Once payment is approved in 342 the offer is deemed complete and the order is fulfilled in 344.

If an order is not accepted in 348, it will not be fulfilled and the seller will be notified (e.g., via email, instant messenger, update of listing, etc). This determination will terminate the offer and notify the bidder of such information at which time they will have the option to resubmit a new offer on the same item.

Upon an offer rejection in 344 the bidder may be notified (e.g., via email, instant messenger, update of listing, etc) of any the offer rejection. This differs from an offer that has been auto-withdrawn in 346 leading to an order not fulfilled in 348 if the seller was proactive and rejected the offer. Such action will give a seller additional options to communicate a recommended alternative offer, although a re-submission on the same offer results in offer restrictions. Offer restrictions may be used as a safeguard for sellers. In one embodiment, the variables of the offer must change in order to be re-submitted. For example, with outdoor advertising billboards, the main negotiation factors, other than location, is time and money. In this example, the timeframe in which a billboard is requested would need to change by a factor of X weeks and the offer amount would need to increase.

Recommendations on rejected offers may include changing the offer item completely, the timeframe of the offer, the location, color, shape, size, texture, or any other aspect of the product or service in 352. This action may not adjust or change any aspect of the buyer proposed offer, instead it may enable the seller to make a recommendation to the buyer on a product or service and aspects there of that may be accepted should the buyer wish to re-submit a new offer. This distinction is important because all offers are binding so sellers may not be able to adjust a buyer proposed offer. In this way, the buyer and the seller may negotiate to reach a mutually agreed sale price for the product or service with the understanding that a buyer can generate a binding agreement and a seller can accept a binding agreement. In certain embodiments, this process could be reversed where binding offers can be generated from both buyers and sellers.

The ecommerce system may receive the seller recommendation with the option to adjust all aspects of the submitted buyer generated offer, and the ecommerce system may notify the buyer of the recommendation (e.g., via email, instant messaging, among other notification mechanisms). The recommended offer may then be presented to the buyer for re-submission of the new recommended offer in 354. In further embodiments, recommendations on rejected offers may be automatically generated, e.g., by the ecommerce system, rather than by a seller.

In 356, the Buyer may receive notification of alternate offer(s) (e.g., via email, instant messaging, among other notification mechanisms).

Figure 5:
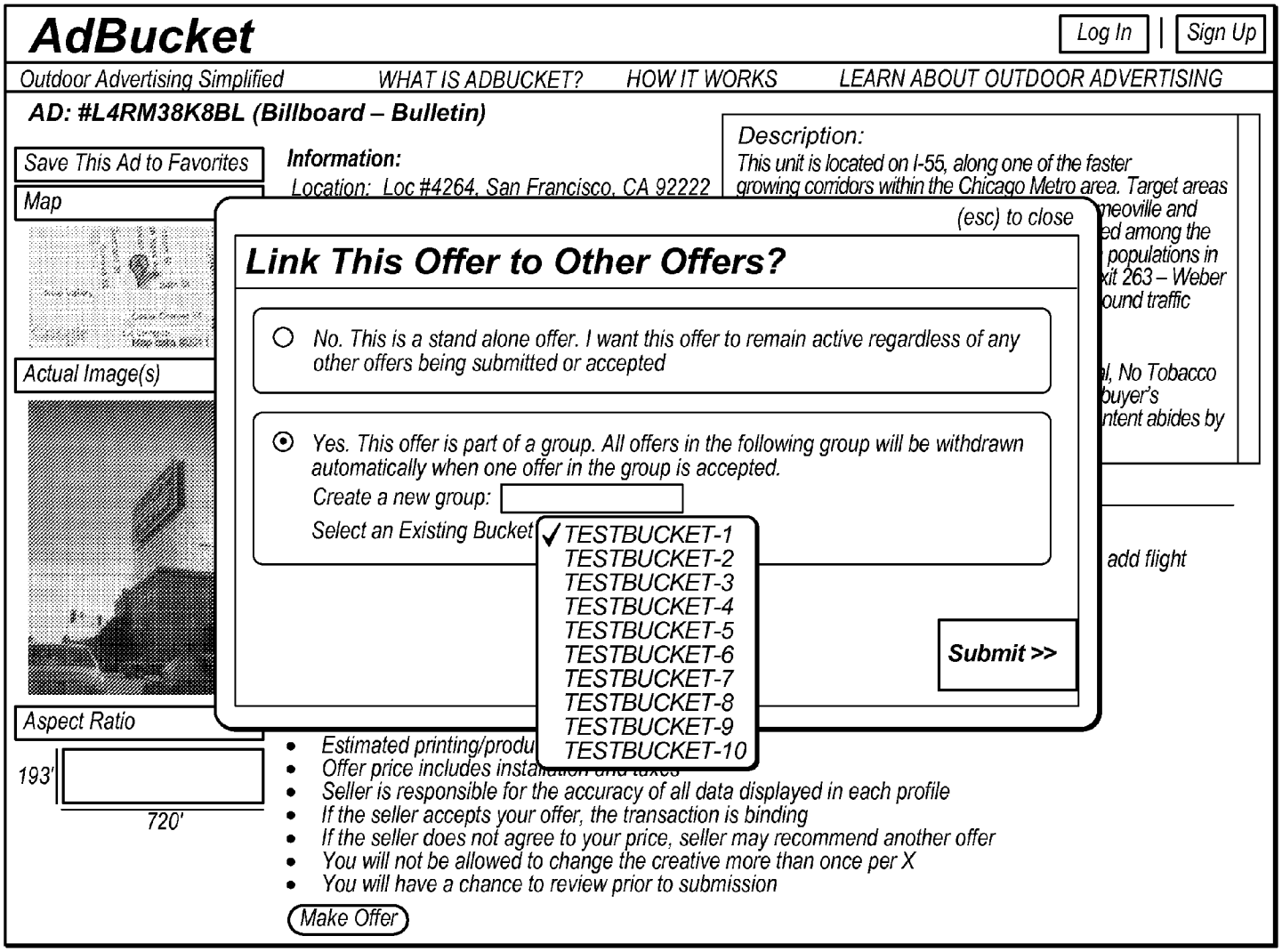
FIG. 5 depicts a user adding the offer to other offers, according to one embodiment.
Figure 6:
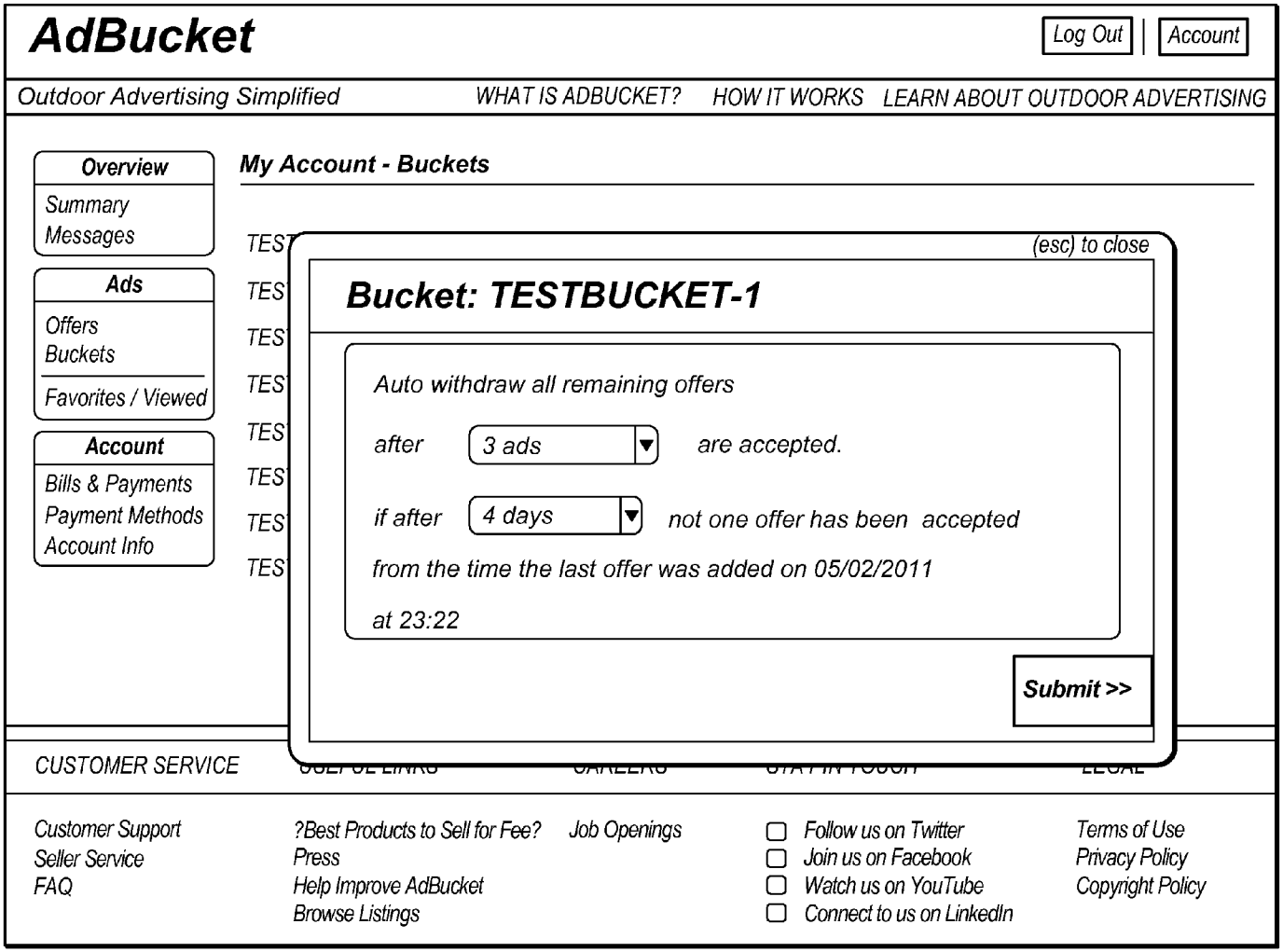
FIG. 6 depicts a user setting up the conditions for a group of offers, according to one embodiment.

FIGS. 4-6—Exemplary Screen Shots

FIGS. 4-6 are exemplary screen shots corresponding to one embodiment of the methods described above. The depictions in FIGS. 4-6 are exemplary only and are not limiting.

As shown in FIG. 4, a user has selected item #L4RM38K8BL, which is a billboard—bulletin. In the exemplary interface of FIG. 4, the location of the billboard is described in text and shown on a map. Additionally, an image of the bill board is shown, as well as further information (e.g., list price, print estimate, size, read, facing, lighting information, EOI, description, restriction, etc. In this example, the buyer proposed price of $8,000 is being made on the billboard for the period of May 3, 2011 to Jul. 30, 2011. In this example, the buyer has not elected to add this offer to other offers. Please note that the information represented in this screen shot is for demonstration purposes only and should not be taken literally as the ad unit represented does not correlate with the description of this particular unit or any other information on the page.

In the user interface of FIG. 5, the buyer may elect to add the offer to a bucket or collection of offers. More specifically, in this example, the buyer has elected to add the offer to other offers. By selecting "yes" this offer is now going to become part of a group "bucket" and all offers in the following group will be withdrawn automatically when one offer in the group is accepted. This buyer has elected to put offer into Test-Bucket-1 rather than crating a new bucket. For this example the buyer has elected to place a contingency of one on the group, thus enabling all other offers to be auto withdrawn after one of the buyer proposed offers is accepted by one of the sellers.

In the user interface of FIG. 6, the buyer has elected to place two contingencies on TESTBUCKET-1. The first contingency mandates that if three offers placed on three ads are accepted then the commerce system will auto withdraw all other offers in the bucket. The second contingency mandates that if no offers in the bucket are accepted by a seller within four days from the time the last offer was placed in the bucket, all offers within the bucket will be auto withdrawn.

ADVANTAGES

By globally aggregating a large number of consumers through one commerce system and in one place online, embodiments described above give them the opportunity to make legally binding offers on a number of products or services with a pre-established risk factor for any given group of items, and sellers are likely to receive multiple offers on products or services, shifting the power of risk from the buyer to the seller. Accordingly, the buyer may at all times know what the total liability is for any given "bucket", where the seller will not know the other items in the "bucket" or the offer amounts. Because of this, the seller must evaluate if the offer is worth accepting based on knowledge of potential competition, and if they choose not to accept it in a timely manner, they must realize the risk that the opportunity to accept will be taken away. For example, if too much time lapses between the time a seller wants to accept and actually does accept an offer, a competing offer in the same "bucket" may have already been auto-accepted leaving the seller without the opportunity to reject or recommend a new offer to the buyer.

Embodiments described above may enable a product or service to be posted for sale regardless of availability or the ecommerce service's knowledge of availability. Additionally, sellers may be provided adequate time to respond to offers and incentive for responding quickly. Additionally, buyers may be provided with a micro marketplace, the "bucket", where offer statuses are contingent against other offers in the same "bucket" or rules associated therewith.

Some customers often require renting or buying multiple products or services, and given that the ecommerce service may not know when the products and services it sells become available to rent or buy, the transaction offer method may allow for that uncertainty. This offers true market value to buyers and sellers. Additionally, this model allows sellers to receive binding offers on products or services; however, it may not guarantee that sellers who receive an attractively priced offer may defer immediate acceptance without risk of losing the offer. Sellers, in this instance, continue to be in direct competition with other sellers even after an offer is received.

This new buying model presents a new problem set that has not been explored in other buying models. For example, traditional models do not allow buyers to make multiple binding offers within a group and not require that all the binding offers be purchased by the buyer. Moreover, an online group-buying site with an auto-withdraw system enables the offer to have an additional contingency placed on it that pits the offer against other offers for acceptance in the group or "bucket". Depending on the conditions pre-established for the group, one or many offers may be accepted prior to the remaining offers auto-withdrawing. The online grouping of products puts the responsibility for acceptance on the seller.

Thus, benefits of the embodiments described above includes but is not limited to, an incentive for sellers to actively participate in offers submitted because they are now in competition with other sellers to accept or decline offers. By not declining prior to another seller accepting an offer in a group, the seller forfeits the ability to counter offer or submit a recommendation to the buyer. In some embodiments, the seller may not be notified if the buyer submitted an offer or offers in a bucket or not. If a seller knew that the offer was made independently of all other offers, than perhaps the need to respond as quickly would not be present. The buyer may have chosen to put the offer in a bucket of one or a bucket of twelve as shown in FIG. 3. The uncertainty puts added pressure on the seller and a tremendous amount of power in the hands of the buyer. No longer does a buyer need to wait for an offer to close in order to place more offers to more sellers on more products and services "bid". In current offer models, a buyer's total liability extends to all the legally binding offers the buyer submits to sellers. This solution limits a buyer's exposure to the maximum amount of the pre-selected number of products or services within a bucket (where that attribute is used as part of the contingencies on the bucket). The amount of a product or service is defined by the commerce system and is not necessarily strictly bound to a currency transaction. Barter and trade could be considered forms of payment in some commerce systems as well. In which case the buyer would need to pre-establish with the form of payment prior to purchase.

Although the embodiments above have been described in considerable detail, numerous variations and modifications will become apparent to those skilled in the art once the above disclosure is fully appreciated. For example, while many of the embodiments above are described with respect to a cloud server, simpler embodiments involving a single server are also envisioned. It is intended that the following claims be interpreted to embrace all such variations and modifications.

The invention claimed is:

1. A non-transitory computer accessible memory medium that stores program instructions, wherein the program instructions are executable to:

receive a group of offers from a buyer over the network, where the group includes a first plurality of offers, where the group of offers has one or more associated contingencies specifying required conditions for the plurality of offers, and where the offers are for a corresponding heterogeneous group of items;

receive input from at least one seller over the network specifying acceptance or rejection of at least one first offer of the first plurality of offers;

remove the at least one first offer from the group of offers based on the specified acceptance or rejection, thereby modifying the group, resulting in the group comprising a second plurality of offers with corresponding contingencies; and automatically remove one or more of the second plurality of offers from the group based on applying the associated contingencies to the group, thereby further modifying the group, resulting in the group comprising one or more offers;

wherein the one or more offers are selectable for acceptance or rejection.

2. The non-transitory computer accessible memory medium of claim 1, wherein the program instructions are further executable to:

add one or more new offers to the group after said automatically removing, thereby further modifying the group, resulting in the group comprising a third plurality of offers.

3. The non-transitory computer accessible memory medium of claim 1, wherein the program instructions are further executable to alter the group in response to input by sellers or the buyer, after which the offers in the group are selectable for acceptance or rejection.

4. The non-transitory computer accessible memory medium of claim 1, wherein the one or more associated contingencies specify at least one condition applied to the group of offers collectively.

5. The non-transitory computer accessible memory medium of claim 4, wherein any offers added to the group are subject to the one or more associated contingencies that specify the at least one condition applied to the group of offers collectively.

6. The non-transitory computer accessible memory medium of claim 1, wherein the one or more associated contingencies specify at least one condition applied to individual offers of the group of offers.

7. The non-transitory computer accessible memory medium of claim 1, wherein, in response to the input from the at least one seller over the network specifying acceptance or rejection of the at least one first offer, the at least one first offer is processed automatically.

8. The non-transitory computer accessible memory medium of claim 1, wherein, in response to the input from the at least one seller over the network specifying acceptance or rejection of the at least one first offer, the at least one first offer is processed manually.

9. The non-transitory computer accessible memory medium of claim 1, wherein the input from the at least one seller is generated automatically.

10. The non-transitory computer accessible memory medium of claim 1, wherein the input from the at least one seller is generated manually.

11. The non-transitory computer accessible memory medium of claim 1, wherein the at least one seller is not informed of the one or more contingencies.

12. The non-transitory computer accessible memory medium of claim 1, wherein the program instructions are further executable to:

associate the one or more contingencies with the group of offers.

13. The non-transitory computer accessible memory medium of claim 1, wherein the group of offers comprises offers made on one or more of:

goods or services for purchase;

goods or services for rent;

goods or services for trade;

transaction credits; or virtual currency.

14. The non-transitory computer accessible memory medium of claim 1, wherein said receiving the group of offers comprises:

receiving first input from the buyer specifying a first offer;

receiving second input from the buyer specifying a second offer;

receiving third input from the buyer associating the first offer and the second offer to form the group of offers.

15. The non-transitory computer accessible memory medium of claim 1, wherein the one or more contingencies comprise a single acceptance contingency, wherein said automatically removing comprises canceling all of the plurality of offers except for the at least one first offer based on said receiving input from the at least one seller specifying acceptance of the at least one first offer.

16. The non-transitory computer accessible memory medium of claim 1, wherein the one or more contingencies comprise a threshold number of accepted offers.

17. The non-transitory computer accessible memory medium of claim 1, wherein the one or more contingencies comprise a threshold price limit.

18. The non-transitory computer accessible memory medium of claim 1, wherein the one or more contingencies comprise a time limit.

19. The non-transitory computer accessible memory medium of claim 1, wherein the program instructions are further executable to:

receive input from the buyer specifying at least one contingency, wherein said associating is performed in response to the input from the buyer specifying the at least one contingency.

20. The non-transitory computer accessible memory medium of claim 1, wherein said receiving the group of offers from the buyer comprises:

receiving first input from the buyer selecting the group of offers, wherein the group of offers is predetermined.

21. The non-transitory computer accessible memory medium of claim 1, wherein the group of offers received from the buyer specifies an offer price for each of the first plurality of items.

22. A method, comprising:

receiving, by a computing device, a group of offers from a buyer over a network to which the computing device is connected, where the group includes a first plurality of offers, where the group of offers has one or more associated contingencies specifying required conditions for the plurality of offers, and where the offers are for a corresponding heterogeneous group of items;

storing, by the computing device, the group of offers in a memory of the computing device;

receiving, by the computing device, input from at least one seller over the network specifying acceptance or rejection of at least one first offer of the first plurality of offers;

removing, by the computing device, the at least one first offer from the group of offers based on the specified acceptance or rejection, thereby modifying the group, resulting in the group comprising a second plurality of offers with corresponding contingencies, wherein said modifying the group comprises modifying the group of offers in the memory; and automatically removing, by the computing device, one or more of the second plurality of offers from the group based on applying the associated contingencies to the group, thereby further modifying the group, resulting in the group comprising one or more offers, wherein said further modifying the group comprises further modifying the group of offers in the memory;

wherein the one or more offers are selectable for acceptance or rejection over the network.

* * * * *